United States Patent [19]

Janssen et al.

[11] Patent Number: 4,702,345

[45] Date of Patent: Oct. 27, 1987

[54] HEARING AID RETENTION DEVICE

[76] Inventors: Gwen V. Janssen; Roy C. Rowland, both of 2610 NW. Expressway, Oklahoma City, Okla. 73112

[21] Appl. No.: 887,874

[22] Filed: Jul. 21, 1986

[51] Int. Cl.[4] ..... H04R 25/00

[52] U.S. Cl. ..... 181/129; 181/135; 381/68.7; 381/187

[58] Field of Search ..... 181/126, 129, 133–135; 179/107 H

[56] References Cited

U.S. PATENT DOCUMENTS 3,906,478 9/1975 Smey ..... 179/107 H X 4,529,058 7/1985 Emery ..... 181/129

*Primary Examiner*—Benjamin R. Fuller

*Attorney, Agent, or Firm*—Robert K. Rhea

[57] ABSTRACT

In a hearing aid of the type, including a battery containing housing supported rearwardly of the ear auricle by an elongated tube joining one end of the housing to an ear opening contained ear molding, an endless flexible ring surrounds the ear auricle at its juncture with the head and a pair of flexible bands transversely surrounding intermediate portions of the ring also transversely surround, in supporting relation, the hearing aid housing to maintain it in a desired location.

1 Claim, 5 Drawing Figures

HEARING AID RETENTION DEVICE

BACKGROUND OF THE INVENTION

1. Field of the Invention

This invention relates generally to hearing aid accessories. More specifically, it relates to devices for supporting a hearing aid from the ear.

2. Description of Prior Art

It is well known to those persons who wear or are acquainted with hearing aids that conventionally they are supported on the ear by means of ear molds and ear hooks in order to securely hold the hearing aid in proper place. Accordingly, it is necessary to alter the size or shape of the ear mold. It may also be necessary for the ear hooks to be specially shaped or sized and possibly be specially flexible. The hearing aid case may also be specially shaped. These limitations are of course objectionable so that there is a need for improvement in the retention of hearing aid devices on the ear.

SUMMARY OF THE INVENTION

Therefore, it is a principal object of the present invention to provide a hearing aid retention device that eliminates the above indicated problems or reshaping and resizing of ear molds and ear hooks by means of simply clipping around the hearing aid device and also looping directly around an ear auricle for support.

Another object, accordingly, is to provide a hearing aid retention device that is quick and easy for attachment.

Other objects are to provide a hearing aid retention device that is simple in design, inexpensive to manufacture, rugged in construction and efficient in operative use.

These and other objects will be readily evident upon a study of the following Specification and the accompanying Drawing.

DETAILED DESCRIPTION

Figure 1:
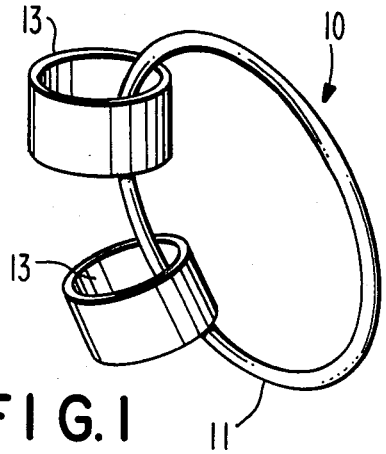
FIG. 1 is a perspective view of a hearing aid retention device, shown in accordance with the present invention.
Figure 2:
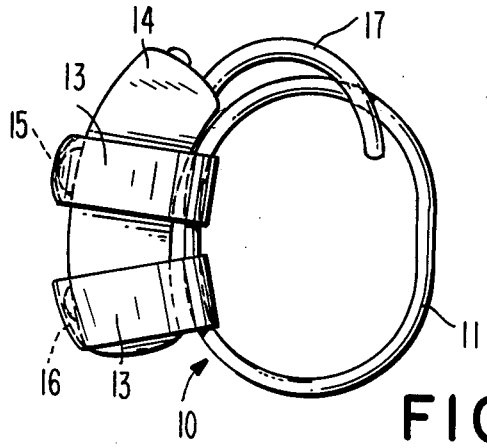
FIG. 2 is a front elevational view of the invention, shown with a typical hearing aid.
Figure 3:
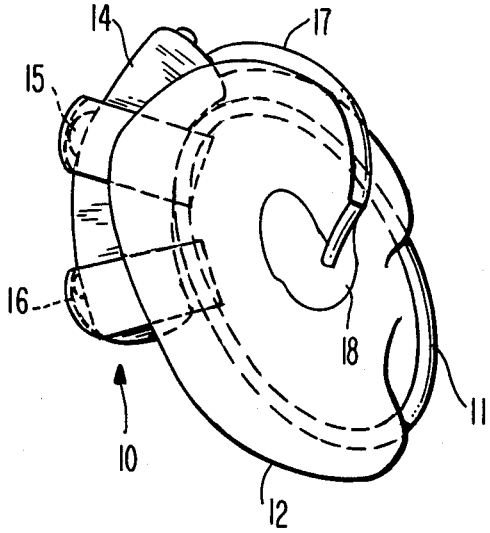
FIG. 3 is a perspective view of the invention, shown as it would be used on an ear as a retention device.

Referring now to the drawing in greater detail, and more particularly to FIGS. 1 to 3 thereof, at this time, the reference numeral 10 represents a hearing aid retention device, according to the present invention, wherein there is a flexible ring 11 made of a soft material, for slipping over and surrounding the auricle 12 or pinna of the ear, and a pair of flexible bands 13 also made of a soft material and which together with the ring form the invention. The two bands are made looped around the ring and serve to slip over the top and bottom portions of a hearing aid 14, as shown in FIG. 2. The flexible bands will readily fit around any of a variety of sizes and shapes of hearing aids and the ring will be manufactured in circumferences to fit all sizes of adults and children; the ring being adaptable to be bent into any shape to conform to the contour of any ear auricle for comfortably and securely retaining the hearing aid in proper position and location against the ear.

The bands are made relatively wide so as to cover up the volume control button 15 and the battery case button 16 of the hearing aid, preventing improper adjustment of the volume setting or removal of the battery, which is a frequently common problem in hearing aid fittings for small children.

The device 10 does not interfere with the hearing aid hooks 17 nor with the ear molds 18.

It can be manufactured in any colors for cosmetic reasons or for easy identification.

Figure 4:
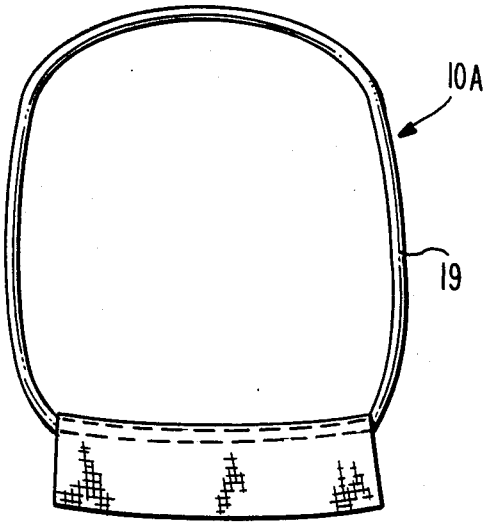
FIG. 4 is a front elevational view of another embodiment of the preferred embodiment of FIGS. 1, 2 and 3, except shown modified to act as an arm sling.
Figure 5:
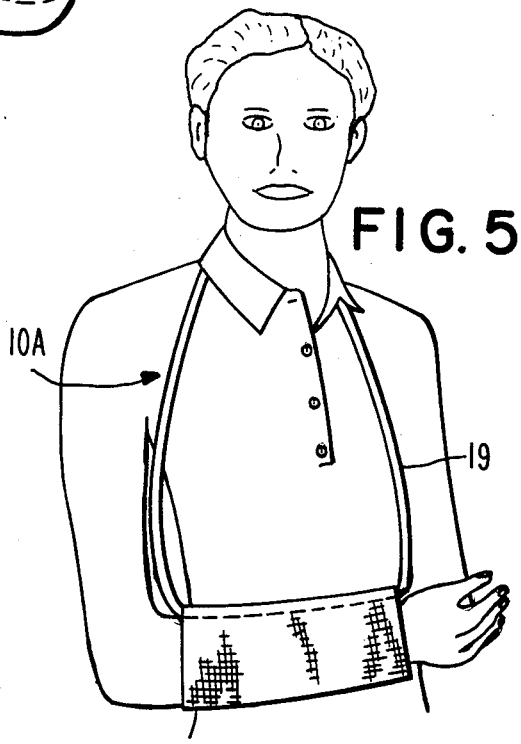
FIG. 5 is a front elevational view of the embodiment of FIG. 4, illustrating it being worn as an arm sling.

Referring now to FIGS. 4 and 5, a modified design of hearing aid retention device **10*a* is shown wherein the above indicated structure is modified to incorporate also an arm sling 19**.

While various other changes may be made in the detail construction, it is understood that such changes will be within the spirit and scope of the present invention as is defined by the appended claims.

What we now claim is:

1. In a normally ear auricle supported hearing aid of the type having an elongated housing arcuately curved longitudinally and adapted to be supported generally longitudinally upright in a space between the auricle and head of a user adjacent a rearward upper limit of a juncture of the ear auricle with the head by an elongated member extending, in inverted generally J-shaped hook fashion across a forward limit of the ear auricle juncture with the head, between an upper limit of the housing and a hearing aid ear mold disposed in an opening of the ear, the improvement comprising:

an endless flexible ring adapted to snugly surround the ear auricle at its juncture with the head with an arc of the ring circumference juxtaposed with said housing; and, at least one endless flexible band, having a width substantially greater than its thickness, transversely tightly surrounding an intermediate portion of the juxtaposition of said endless ring and said housing.

* * * * *